United States Patent [19]

Hutton et al.

[11] Patent Number: 4,782,543

[45] Date of Patent: Nov. 8, 1988

[54] ATTACHMENT OF FLAT SHEETS TO WATERBEDS

[76] Inventors: William B. Hutton; Deanice B. Hutton, both of 58481 Ross Rd., Warren, Oreg. 97053

[21] Appl. No.: 34,424

[22] Filed: Apr. 3, 1987

[51] Int. Cl.[4] ..... A47C 21/02

[52] U.S. Cl. ..... 5/508; 5/498; 24/72.5

[58] Field of Search ..... 5/496, 498, 508, 457, 5/452; 24/72.5

[56] References Cited

U.S. PATENT DOCUMENTS

| | | | |
|---|---|---|---|
| 2,223,412 | 12/1940 | Gartz | 24/72.5 |
| 2,321,394 | 6/1943 | King | 24/72.5 |
| 2,459,497 | 1/1949 | Calabro | 24/72.5 |
| 4,199,830 | 4/1980 | Ogata | 5/498 |
| 4,520,518 | 6/1985 | Reaser | 5/498 |
| 4,521,970 | 6/1985 | Jester | 24/72.5 |
| 4,662,016 | 5/1987 | Seeman | 5/508 |

FOREIGN PATENT DOCUMENTS

| | | | |
|---|---|---|---|
| 558402 | 1/1944 | United Kingdom | 24/72.5 |

*Primary Examiner*—Alexander Grosz

*Attorney, Agent, or Firm*—Chernoff, Vilhauer, McClung & Stenzel

[57] ABSTRACT

A device for attaching flat bed sheets and other bed covers to a waterbed and for retaining them neatly in a desired position atop the mattress of a waterbed includes a fastener including a slot and stud combination, attached to an elastic connector extending from the fastener to a retainer portion of relatively stiff construction and extending parallel with the bottom of the waterbed, beneath the mattress thereof. The retainer may include openings therethrough, or in another embodiment may include suction cups for gripping the lower surface of the mattress.

21 Claims, 3 Drawing Sheets

FIG. 1
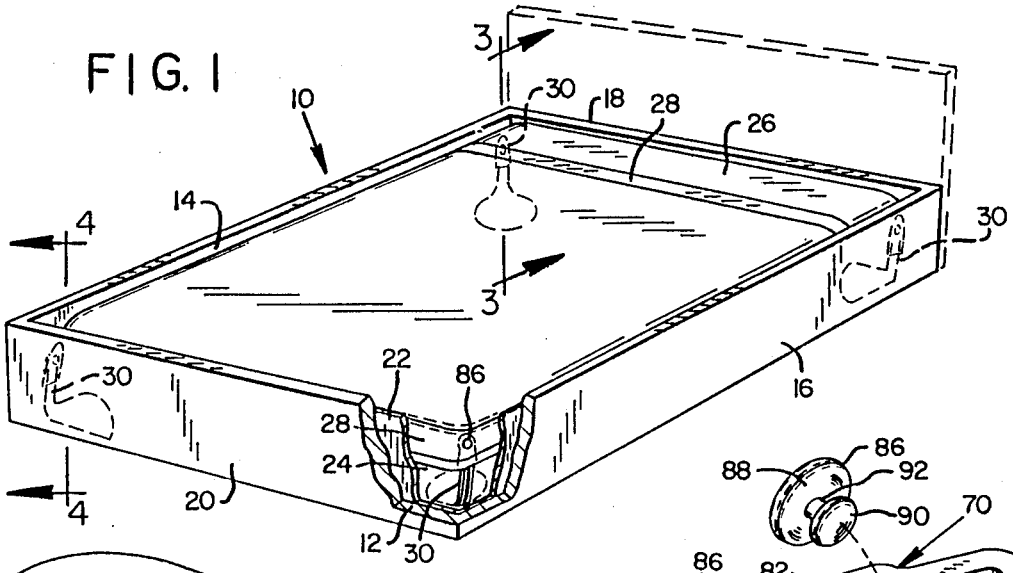
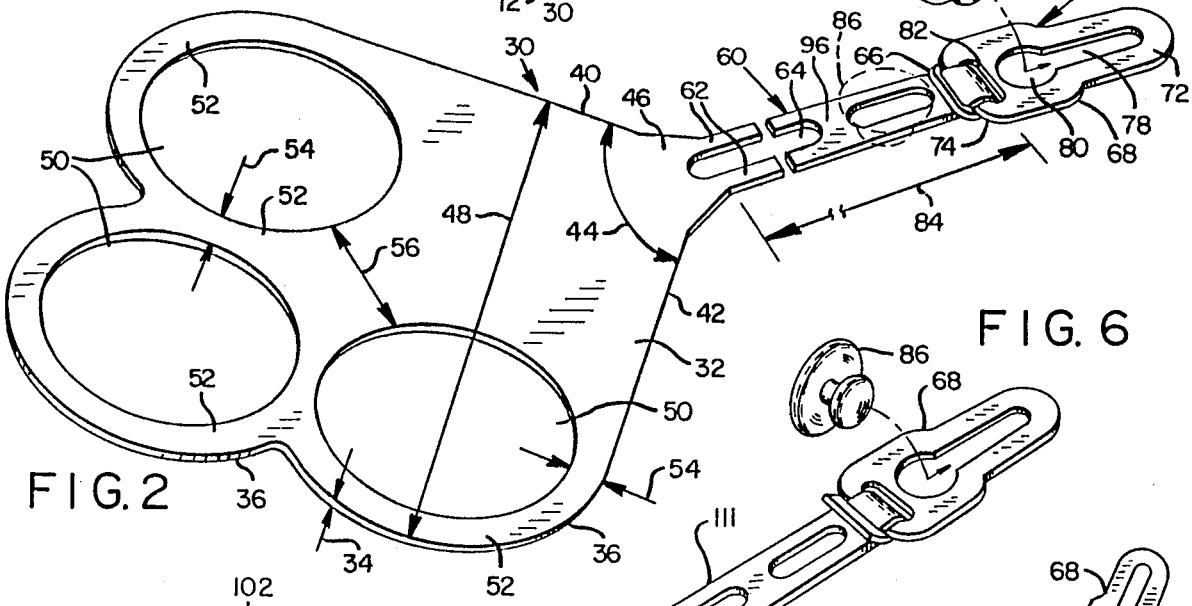
FIG. 2
FIG. 6
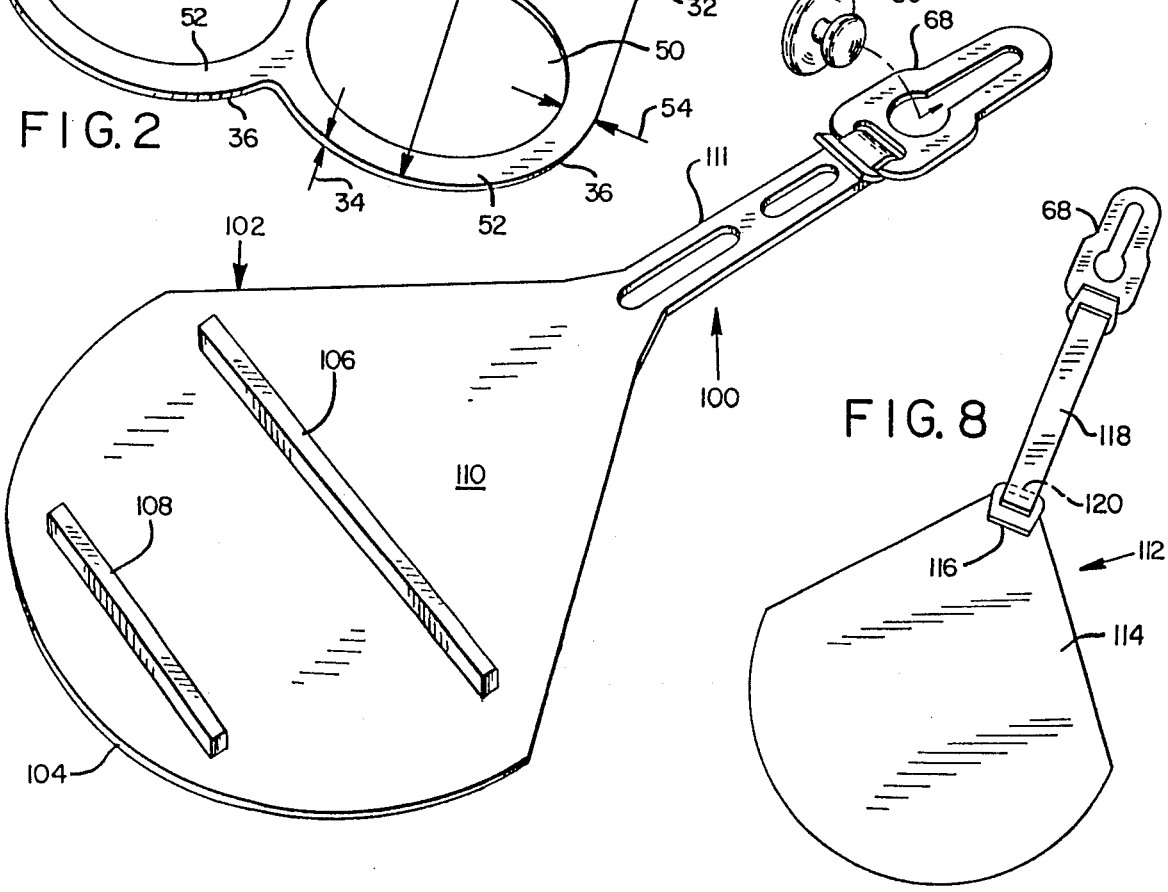
FIG. 8

ATTACHMENT OF FLAT SHEETS TO WATERBEDS

BACKGROUND OF THE INVENTION

The present invention relates to waterbeds, and particularly to a device for fastening sheets and the like in place on a waterbed.

Waterbeds of the most common type include a sturdy base supporting a box-like frame which usually includes wooden boards lying on edge and fastened together at the four corners of the frame, as well as a flat bottom structure. This box-like frame contains and supports a fluid-holding mattress. The mattress is, essentially, a water-filled flexible bag, usually made of a sheet plastics material. Ordinarily, a heater maintains the water at a desired temperature and chemicals are used to prevent growth of algae within the mattress.

Because such waterbeds provide a great deal of comfort and in their basic form are less expensive than conventional bedding, waterbeds are increasingly popular. It is also recognized that the support provided by a waterbed is often more appropriate for a person suffering from arthritis or back ailments, and this factor also contributes to the increasing popularity of waterbeds.

A particular disadvantage of waterbeds, however, in comparison with conventional boxspring and mattress bedding, is that it is very difficult to make the sheets used on waterbeds remain neat and snug on the top of the waterbed mattress. Although the bed may be made up neatly, as soon as one rests on it the sheets begin to bunch up and come untucked from around the edges of the waterbed mattress.

This tendency for the sheets to come loose from a waterbed has been countered previously by using very large sheets with plenty of extra material to be tucked under the mattress, by providing diagonal straps on the corners of a waterbed sheet, or by providing specially designed sheets including pockets at their corners for use on waterbeds. While such devices are useful on conventional mattresses, they fail to solve efficiently the problem of sheets coming loose from waterbeds.

Particularly for top sheets, failure to stay securely tucked in place is a serious problem with waterbeds. For that reason top and bottom sheets are sometimes provided as a sewn-together combination. While this helps somewhat to solve the problem of the sheets becoming loose from the bed, it results in a bed sheet over 12 feet in length, which is very difficult to launder.

Any of the above-described sheets designed particularly for waterbeds are at least somewhat difficult to fit onto a waterbed mattress, because of the great weight of the water contained in a waterbed mattress. In order to tuck a pocket portion of a waterbed sheet around a corner of the mattress, a considerable amount of water weight must be lifted. This usually must be accomplished by a person standing bent over beside the bed, and is, at best, an awkward and difficult task. Many people, particularly those who are small in stature, find the routine task of changing the sheets of a waterbed a very difficult one.

Not only is it difficult to replace conventional waterbed sheets, but the sheets designed specifically for waterbeds are much more expensive than sheets for a conventional bed of a comparable size. This is because of the extra labor and materials involved in providing pockets or corner straps on such special sheets, in order to hold them neatly in place on the bed. Additionally, since most special waterbed sheets are sold at the place and time of sale of a new waterbed, a premium price is often charged for such waterbed sheets.

Another problem associated with special waterbed sheets is that, as a result of the high inventory costs, waterbed sheets are available in a relatively small number of colors and patterns, by comparison with the usually available selection of conventional bed sheets. It is therefore undesirably difficult to obtain special waterbed sheets which match the decor of a bedroom.

Various other devices are known which attempt to secure sheets on waterbeds by attachment to frame rails of the waterbed. U.S. Pat. Nos. 3,838,470 and 4,089,075 show two such devices, but these types of devices are not particularly well-adapted to being added to existing waterbeds. Others have attempted to solve the problem by the use of devices attached to waterbed frames to interconnect with buttonholes on yet other special sheets, as shown in McKneelen U.S. Pat. No. 4,486,909. Gilreath U.S. Pat. No. 4,040,133 discloses a strap of plastic film having one end held under the mattress of a waterbed by the weight of the mattress for holding special sheets, etc., equipped with hook-and-loop fasteners of the well-known type available under the trademark Velcro.

One device which performs well and is easily installed in existing waterbeds to hold ordinary flat sheets in place is disclosed in copending Hutton et al. U.S. patent application 733,701, filed May 13, 1985, now U.S. Pat. No. 4,660,240. Although this device works perfectly well, its installation requires a screw or similar fastener to pierce the liner of the waterbed frame, causing some reluctance to install the device.

What is needed, therefore, is an improved device for attaching ordinary flat sheets neatly to a waterbed, which would be inexpensive and easily installed, and whose installation would not require the liner of the waterbed frame to be punctured.

SUMMARY OF THE INVENTION

The present invention overcomes the aforementioned shortcomings and disadvantages of previously known devices for attaching sheets to waterbeds by providing an easily installed bed sheet attachment device for holding ordinary flat sheets in place on a waterbed. According to the present invention, a bed sheet attachment device for use in combination with a waterbed includes a fastener for gripping the sheets of a waterbed, preferably at locations near the corners of the waterbed. The fastener is attached to an elongate elastic connector which is held in a desired location on the waterbed by a generally planar attachment member or retainer preferably of suitable material having a high coefficient of friction and preferably some adhesion relative to the surfaces of a waterbed mattress or liner, which is placed beneath a portion of the waterbed mattress and held in place by friction and adhesion between the retainer and the liner or the water-filled mattress. The elastic connector, when properly attached to the waterbed's sheets, continuously exerts a small amount of tension on the sheets, keeping them neatly taut despite some movement of the mattress.

The preferred form of the fastener portion of the waterbed sheet attachment device of the present invention is disclosed in Hutton et al. U.S. patent application Ser. No. 06/733,701, filed May 13, 1985, now U.S. Pat. No. 4,660,240 and includes a plate defining a slot extending through it. One end of the slot is enlarged to receive one end of a stud, with a portion of the bed sheet being placed around the stud. The plate is placed beneath the sheet and the stud is pushed down through the enlarged portion of the slot from above the sheet, with surrounding portion of the sheet being forced into the slot. The stud is then slid into the narrow portion of the slot to grip the sheet between the interior of the slot and the neck of the stud.

In a preferred embodiment of the invention the retainer portion and the elastic connector are molded as an integral piece of a suitable rubber-like thermoplastic synthetic material, and an opposite end of the connector portion is fastened to the plate portion of the fastener. The retainer is simply placed flat atop the liner on the bottom of the waterbed frame, and the mattress is replaced and permitted to rest on top of the retainer. The length of the exposed part of the elastic connector portion can be regulated by the placement of the retainer, and even if the retainer is moved by excessive tension in the connector it cannot be pulled too far out of position because of its shape. Normally, the shape of the retainer prevents it from moving, as it includes holes through which portions of the mattress can protrude, raised areas in the form of bars, etc., or suction cups or other fasteners on its surface to grip the waterbed mattress. When the attachment device of the present invention is properly installed, it is unnecessary to lift the water-filled mattress to place sheets neatly on a waterbed, and the stud portion of the two-part fastener may be kept out of sight between the mattress and the bed frame when the device is holding sheets in place on a bed, by placing the retainer portion so as to leave an appropriate length of the connector exposed.

As a result, flat sheets in a smaller size than that normally used on a conventional bed may be used on a waterbed of the same size, making a much larger available selection of sheets useable on waterbeds. Because the sheets made useable on a waterbed by the present invention are smaller and are stocked in more stores, consequently, creating more price competition, the present invention reduces the cost of providing sheets for waterbeds.

It is therefore a principal object of the present invention to provide an improved device for holding sheets neatly in place on a waterbed.

It is another important object of the present invention to provide a device by which sheets can be fastened in place on a waterbed quickly and easily and without having to lift a corner of a heavy waterbed mattress after initial installation of the device of the invention.

It is yet another object of the present invention to provide a sheet holding device which can be installed quickly.

An important feature of the present invention is the provision of a retainer by which the fastener of the device can be attached to a waterbed without puncturing a waterbed frame liner.

Another important feature of the invention is the adjustability available in moving the retainer to leave a desired length of the elastic connector portion exposed.

It is a principal advantage of the present invention that it allows use on a waterbed of conventional sheets which are thus less expensive, than the special waterbed sheets designed for use on a waterbed of the same size.

Another important advantage of the present invention is that it enables a waterbed to be kept neater in appearance than previously has been possible.

The foregoing the other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective, partially cut-away, view of a waterbed equipped with bed sheet attachment devices embodying the present invention.

FIG. 2 is a perspective view of one of the bed sheet attachment devices shown in FIG. 1, at an enlarged scale.

FIG. 6 is a perspective view of an alternative embodiment of the waterbed sheet attachment device of the invention.

FIG. 8 is a view of another embodiment of the waterbed sheet attachment device of the present invention.

DETAILED DESCRIPTION OF THE INVENTION

Figure 4:
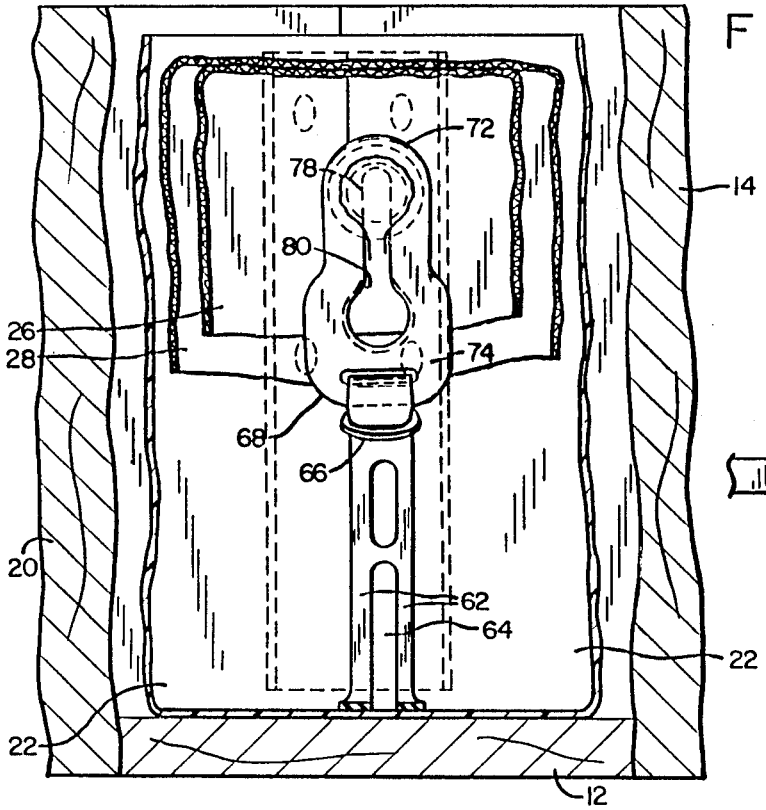
FIG. 4 is a sectional view of the bed sheet attachment device of the invention and a portion of the waterbed, taken along line 4—4 of FIG. 1.

Referring now to the drawings, and particularly to FIGS. 1–4, a waterbed 10, shown in FIG. 1, includes a frame having a bottom 12 and four upstanding walls, a pair of opposite side walls 14 and 16, a head end wall 18, and a foot end wall 20. The walls extend upwardly from the bottom 12, forming an upwardly open box-like container. A liner 22 of watertight construction is located within the frame to prevent escape of water which might leak from a failed mattress 24. The mattress 24 is a flexible water-tight container holding a quantity of fluid, usually water.

A pair of sheets, a bottom sheet 26 and a top sheet 28, are held on the waterbed 10, neatly and snugly stretched across the top of the mattress 24 by a plurality of bed sheet attachment devices 30 embodying the present invention. Preferably, one of the bed sheet attachment devices 30 is located in each of the corners of the bed 10 formed by intersection of adjacent ones of the walls 14, 16, 18 and 20. The sheet attachment devices 30 hold the sheets 26 and 28 and apply a desired amount of tension to hold them snugly in a desired position atop the mattress 24 as will be explained presently.

As may be seen in FIG. 2, each of the attachment devices 30 includes a retainer portion 32 which is generally planar in form, and which may be of molded construction. The retainer 32 has a thickness 34 and a peripheral surface 36 which extends around a pair of opposite major faces 38. A pair of convergent sides 40 and 42 define an angle 44 with respect to each other at a corner portion 46 of the retainer 32. The angle 44 is preferably approximately a right angle, in order to correspond generally with the corners of the waterbed 10 defined by intersections of the upright walls 14, 16, 18, and 20, although an angle 44 of any size between approximately 60 degrees and approximately 120 degrees would also be acceptable. A width 48 of the retainer 32 is about 7", in a preferred embodiment of the invention, so that the retainer 32 has an area of at least about 13 square inches.

The retainer portion 32 defines three circular openings 50 framed by respective rim portions 52 each having a width 54 about twice as great as the thickness 34. In the preferred embodiment of the invention shown in FIG. 2, the circular openings 50 are about $2\frac{3}{8}$" in diameter and the width 54 of the rims is about $\frac{3}{8}$". The two circular openings 50 adjacent the sides 40 and 42 are separated from each other by a distance 56 of about $1\frac{3}{4}$".

A connector portion 60 extends away from the retainer portion 32 in a direction which is an extension of the bisector of the angle 44. The connector 60 is elastic and is able to stretch far enough to permit the desired amount of movement of the sheets 26 and 28 with respect to the mattress 24, as will be explained in greater detail subsequently.

The connector 60 may consist of a pair of parallel parts 62 separated by a slot 64, in order to provide a desired amount of torsional stability yet not require an undesirably great amount of force to stretch the connector 60 in response to movement of the bed coverings to which the attachment device 30 is attached. An outer end of the connector defines a loop 66 used to attach the connector 60 to a first or plate member 68 of a fastener 70 utilized to grip bed coverings such as the sheets 26 and 28 to fasten them to the waterbed 10.

The retainer portion 32 and connector 60 are preferably formed integrally of a thermoplastic rubberlike synthetic material of suitable strength and elasticity and capable of being formed by injection molding processes. Such a material is available from the Shell Oil Company under the trade name KRATON D2103. This material may be stretched elastically to double its relaxed length without failure, and it gradually adheres to the plastic materials used as the water-containing bag of a waterbed mattress. By choosing an adequate thickness 34 of the retainer 32, the retainer 32 may be kept relatively stiff by comparison with the parallel parts 62 of the connector 60 even though integrally formed.

Figure 3:
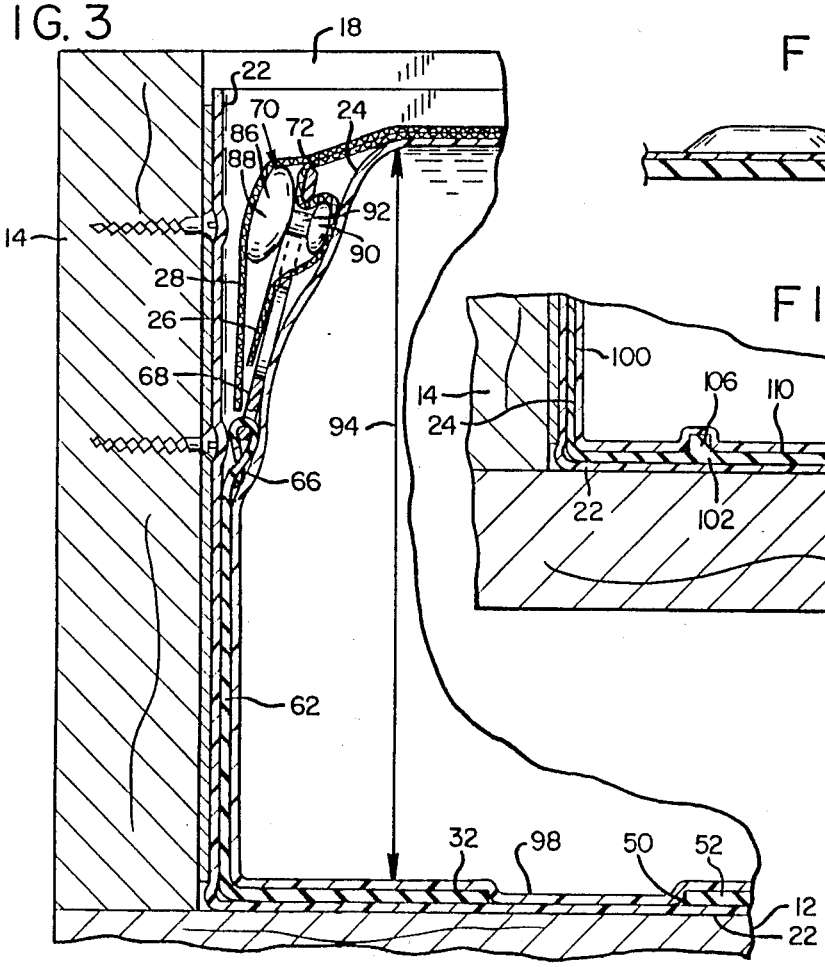
FIG. 3 is a sectional view, at an enlarged scale, taken along line 3—3 of FIG. 1, showing one of the sheet attachment devices of the present invention in use.

As described in Hutton et al. U.S. patent application Ser. No. 06/733,701 filed May 13, 1985 now U.S. Pat. No. 4,660,240, a plate or first member 68 of the fastener portion 70 may be made of a conveniently formed material such as a tough, rigid plastics material. The first or plate member 68 has an upper end 72 and a lower end 74, the words "upper" and "lower" referring to the normal position of the plate member 68 when the attachment device 30 is in use, as shown in FIGS. 3 and 4. The plate member 68 is generally flat, having opposite sides which are generally parallel, and a thickness which is great enough (for example, at least about $\frac{1}{8}$") to supply necessary strength and avoid sharp corners or edges which might tear the sheets 26 and 28.

An opening extends through the first member from the first side to the opposite side, and defines an elongate slot 78 including a circular enlargement 80 located proximate the lower end 74 of the plate member 68. The slot 78 preferably tapers inward slightly to a smaller width closer to the upper end 72 of the first member 68. As will be appreciated, the circular enlargement 80 might be of another shape, as long as it is larger than the width of the slot 78, which extends beyond the enlargement 80 toward the upper end 72 of the first member 68.

A transverse slot 82 extends through the first member 68 substantially perpendicular to the slot 78. The loop 66 of the connecting member 60 extends through the slot 82 and is looped around the outer end portion of the connector 60, attaching the first or plate member 68 of the fastener 70 to the connector 60. Preferably, the elastic connecting member 60 has a length 84 of about $7\frac{1}{2}$ inches from the corner portion 46 to the transverse slot 82, and may be stretched at least about 3 and preferably 6 or more inches beyond its relaxed length without breaking.

A stud or second part 86 of the fastener 70 includes a circular head portion 88 about 1.25 inches in diameter, a base portion 90 having a diameter smaller than the enlargement 80 of the slot 78, and an interconnecting neck portion 92 whose diameter is only slightly smaller than the minimum width of the slot 78. As the base portion 90 is smaller in diameter than the circular enlargement 80 of the slot 78, and because the width of the slot portion 78 is greater than the diameter of the neck 92, the stud 86 may be fitted into the slot 78 in the first member 68 as is shown in FIGS. 3 and 4, with portions of the sheets 26 and 28 extending around the base 90 and neck 92. Sufficient clearance, but a snug fit, is provided between the neck 92 and the interior of the slot portion 68 to hold the sheets 26 and 28 securely when the stud 86 is located near the upper end 72 within the slot 78.

Preferably, the base 90 of the stud 86 has a flat bottom surface, a frusto-conical upper surface, and a rounded edge joining the bottom and upper surfaces, in order to avoid unnecessarily stressing a sheet held by the attachment device 30. When the fastener 70 is not attached to any bed covering, the stud 86 may be placed between the parallel parts 62 of the connector 60 adjacent the plate or first member 62, where it will be retained in a convenient location by the bridge portion 96 interconnecting the parallel parts 62 proximate the outer end loop 66. The stud 86 is shown in such a storage position in broken line in FIG. 2.

Figure 5:
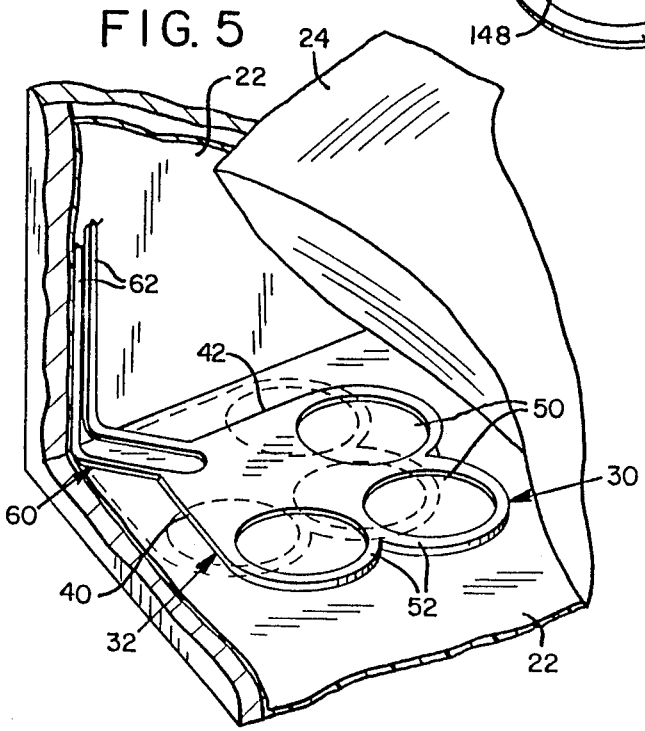
FIG. 5 is a partially cut-away perspective view of one corner of the waterbed shown in FIG. 1, at an enlarged scale, showing the location of an installed sheet attachment device according to the present invention.
Figure 14:
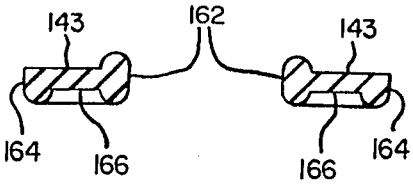
FIG. 14 is a sectional view, taken along line 14—14 of the attachment device shown in FIG. 11.

Referring now to FIGS. 3, 4 and 5, each attachment device 30 is installed in the waterbed 10 by lifting the respective corner portion of the mattress 24 away from the adjacent walls of the waterbed frame. The attachment device 30 is placed within the frame of the waterbed 10 with retainer portion 32 lying flat on the portion of the liner 22 covering the bottom 12. As shown in FIG. 5, it should be spaced far enough apart from the respective walls of the bed 10 to expose only the desired amount of the length 84 of the connector 60, depending upon the height 94 of the mattress 24 (FIG. 3), so as to place the fastener assembly 70 at the desired height relative to the top of the mattress 24. The fastener assembly 70 will then be convenient for use and not undesirably obtrusive upon the appearance of the waterbed 10. The mattress 24 is then allowed to return to its usual position while the fastener 70 is held with the closest portion of the connector 60 extending upwardly within the corner formed by the upright walls of the bed 10.

Once the mattress 24 has been replaced atop the retainer 32, the retainer is held in place by friction between the retainer 32 and the mattress 24 and the liner 22, and, depending on the material of which the mattress 24 and liner 22 are made, adhesion between them and the retainer 32. The lower layer 98 of the mattress 24, under the pressure of the fluid contained within the mattress, conforms to the interior of the openings 50, as may be seen best in FIG. 3. The shape of the retainer 32 then aids in retention of the retainer 32 in its initial position beneath the mattress 24 by allowing portions of the mattress 24 to rest against the vertical peripheral surfaces 36 and the interior of the rim walls 52 of the openings 50. Should the amount of tension exerted through the connector 60 be sufficient to move the retainer 32, however, the configuration of the sides 40 and 42, in combination with the greater stiffness of the retainer 32 resulting from its thickness being greater than the thickness of the parallel parts 62 of the connector 60, will result in the retainer 32 being held in position beneath the mattress 24 with its sides 40 and 42 resting against the inner surface of the liner 22 adjacent the junction between the respective side wall 14 or 16 and the head wall 18 or foot wall 20 forming the corner of the bed 10 where the particular sheet attachment device 30 is located, as shown in broken line in FIG. 5. It is therefore desirable that the retainer portion 32 be relatively stiff by comparison with the connector portion 60 of the waterbed sheet attachment device 30.

To attach the bed sheets 26 and 28 to the waterbed 10, each sheet is laid over the plate or first member 68 of the fastener 70, as it is held up in a desired position adjacent the corner of the mattress 24, with a desired amount of tension applied to the elastic connector member 60. While the plate member 68 is held in the desired position, with the sheets 26 and 28 in place above it, the base 90 of the stud 86 is pushed through the circular enlargement 80 in the plate member, pushing a small part of the sheets 26 and 28 through the circular enlargement of the opening. The stud 86 is then slid into the slot 78 with the sheets 26 and 28 surrounding the neck portion 92. The same process is repeated at each corner of the waterbed 10, with only the bottom sheet 26 being attached in this fashion at the head of the bed. When the sheets 26 and 28 have been attached to the waterbed 10 in this fashion, only the base 90 of each of the studs 86 will be visible, and even the bases 90 will ordinarily be out of view, between the mattress 24 and the walls of the frame of the waterbed 10, if the retainer 32 has been located far enough from the actual corner of the waterbed frame.

When using the bed sheet attachment devices 30 of the present invention it is unnecessary to utilize the bed sheets designed specifically for use with waterbeds, and sheets which are even smaller than would be required for a conventional bed of the same nominal mattress size may be used. For example, flat sheets of the size (81 by 96 inches) recommended for a full (double) bed are large enough to properly cover a king size waterbed (mattress top size 72 by 84 inches), when held in place by the attachment devices 30 of the present invention. Correspondingly, twin bed flat sheets (66 by 96 inches) may be used on queen size (60 by 84 inches) and smaller waterbeds satisfactorily. Thus, when using the attachment devices 30, the cost of bed sheets for the waterbed 10 is greatly reduced, while the appearance of the waterbed 10 is greatly improved and maintained, even during use.

Figure 7:
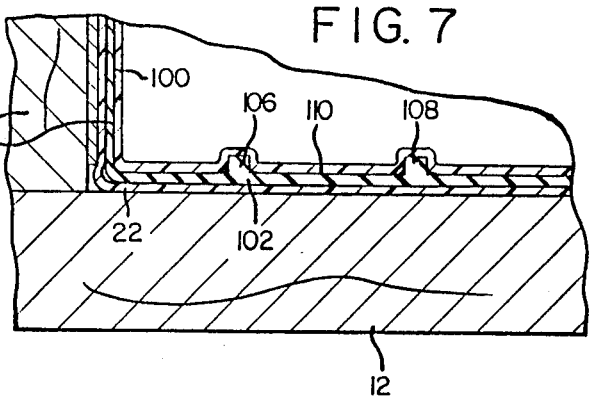
FIG. 7 is a fragmentary sectional view similar to a portion of FIG. 3, and showing the waterbed sheet attachment device of FIG. 6 in place in a waterbed.

Referring now to FIGS. 6 and 7, a waterbed sheet attachment device 100 is similar to the device 30, except that the shape of the retainer portion 102 of the device 100 is different from the retainer 32, including a semicircular outer edge 104 in place of the rims 52 defining the openings 50 in the retainer 32. A pair of parallel bars 106 and 108 project upwardly above the face 110 as shown in section view in FIG. 7 to resist movement of the retainer 102 moving beneath the mattress 24 when tension is applied to the connector portion 111.

A waterbed sheet attachment device 112, shown in FIG. 8, is another embodiment of the invention, and includes a separately made retainer portion 114 defining a slot 116 to which a connector portion 118 is attached by the use of a loop 120 formed as a portion of the connector 118, with the loop 120 passing through the slot 116 and then being placed around the connector 118. This construction permits the retainer 114 to be manufactured of a relatively hard and stiff material while the connector 118 is of a relatively soft and elastic material, if desired.

Figure 9:
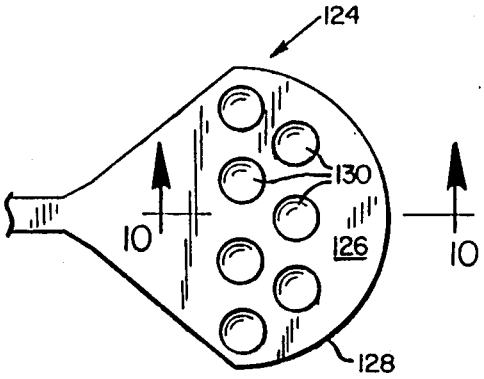
FIG. 9 is a top plan view of the retainer portion and a part of the connector portion of a waterbed sheet attachment device which is a further embodiment of the present invention.
Figure 10:
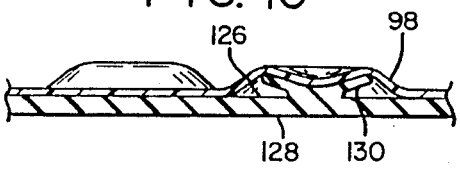
FIG. 10 is a sectional side view of a portion of the waterbed sheet attachment device shown in FIG. 9, and a portion of a waterbed mattress atop the attachment device, taken along line 10—10 of FIG. 9.

Yet another embodiment of the present invention is the waterbed sheet attachment device 124, shown in FIGS. 9 and 10. The attachment device 124 includes, on an upper major face 126 of its retainer portion 128, seven apart-spaced suction cups 130 to grip the lower layer 98 of the waterbed mattress 124 once it has been returned to its normal position during installation of the waterbed sheet attachment device 124 in the method described above in connection with the attachment devices 30. Not only do the suction cups 130 provide their normal suction grip on the lower layer 98, but their upward protrusion with respect to the height of the surrounding portions of the upper major face 126 of the attachment device 124 will also resist lateral movement of the retainer 128 despite tension applied to the connector portion 132 of the attachment device 124.

It will be apparent that other configurations of the upper major face of a retainer portion of a waterbed sheet attachment device of the nature described above are also possible, and that, for example, the suction cups 130 might be replaced by areas of adhesive material or pieces of adhesively mountable hook-and-fastener material.

Figure 12:
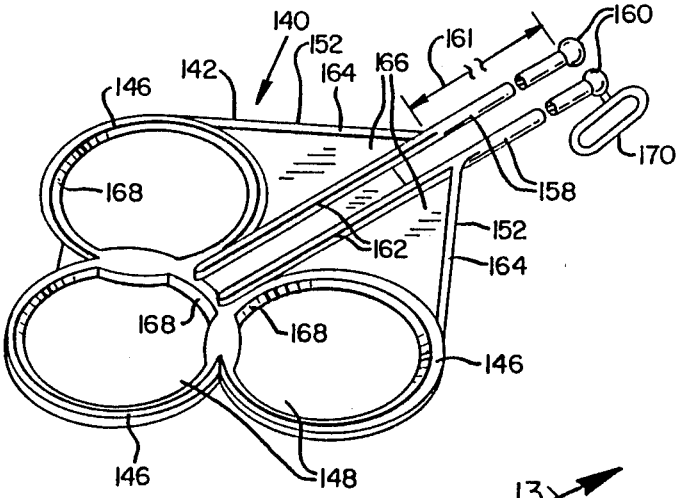
FIG. 12 is a perspective view, showing the bottom side of the waterbed sheet attachment device shown in FIG. 11.
Figure 11:
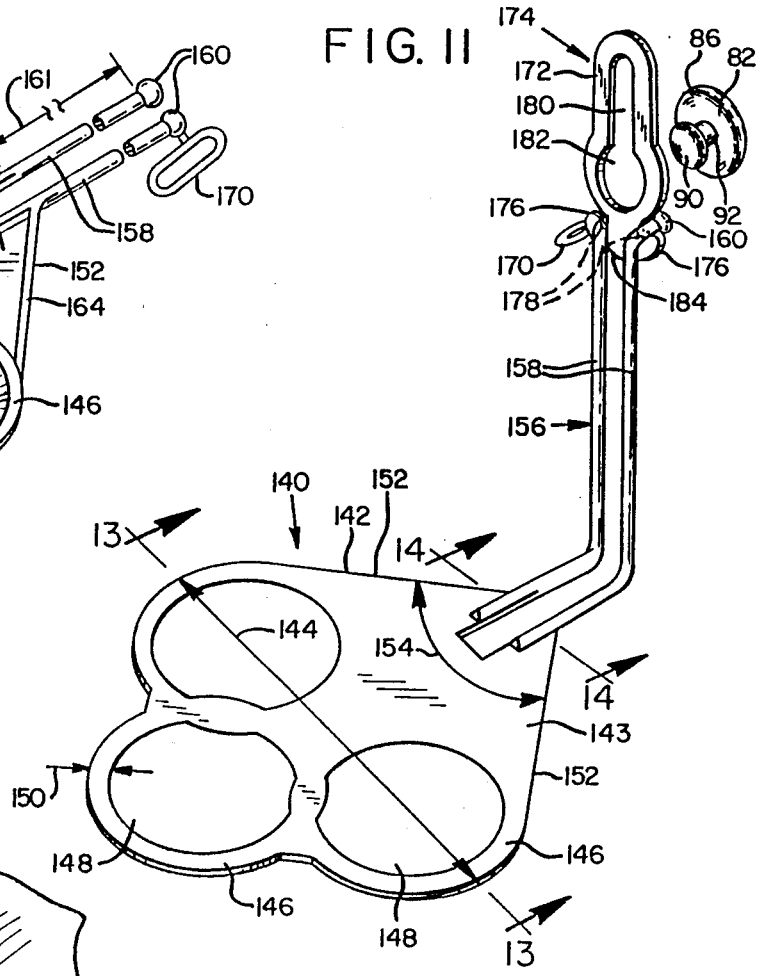
FIG. 11 is a perspective view of a waterbed sheet attachment device which is yet a further embodiment of the present invention.

Yet another embodiment of the present invention is shown in FIGS. 11–14. A waterbed sheet attachment device 140 includes a retainer portion 142, whose width 144 is approximately 8½ inches, giving generally flat upper surface 143 of a retainer portion 142 an area in excess of 13 square inches, excluding the areas of outer rim portions 146, which define three openings 148 (corresponding to the openings 50 in the retainer 32 described previously). Each outer rim portion 146 has a width 150 of about 5/16 inch. A pair of straight sides 152 extend toward one another defining a corner angle 154 of about 90 degrees, similar to the angle 44. A connector portion 156 includes a pair of (parallel elastic cord-like parts 158, each including an enlarged ball-like end portion 160 and having a length 161 of about six inches. Referring also to FIG. 12, it will be appreciated that the cord-like parts 158 extend additionally along the underside of the retainer portion 142, as shown at 162. Similarly, a raised, riblike, edge portion 164 is defined along each of the sides 152 on the bottom side of the retainer portion 142, helping to define relatively thin portions 166 bounded by the edge portions 164, the extension portions 162 of the cord-like parts 158, and portions of the rims 146. In FIG. 12 it may also be seen that the rim portions 146 include conically sloped surfaces 168, whose purpose will be explained presently.

A flexible loop 170 is connected to one of the enlarged ends 160, and is used at times for holding a stud 86, described previously, which cooperates with a plate portion 172, or first member, of a fastener assembly 174, which is used in the same manner as the fastener assembly 70 to hold sheets in place on a waterbed. When the device 140 is not in use attaching sheets to a waterbed, but is installed in a waterbed, the stud 86 may be stored by inserting the base 90 into the loop 170 to keep the stud 86 from being misplaced. The fastener assembly 174, and particularly the plate or first member 172 thereof, is connected to the cord-like parts 158 by a pair of hook portions 176 defined near the lower end of the plate member 172. The hook portions 176 each include a throat area 178 smaller than the enlarged end portion 160 of the cord-like parts 158, and large enough to receive the cord-like parts 158 and hold them securely. As with the plate or first member 68, the plate member 172 defines a longitudinal slot 180 having an enlargement 182 near the lower end 184 of the plate member 172.

Figure 13:
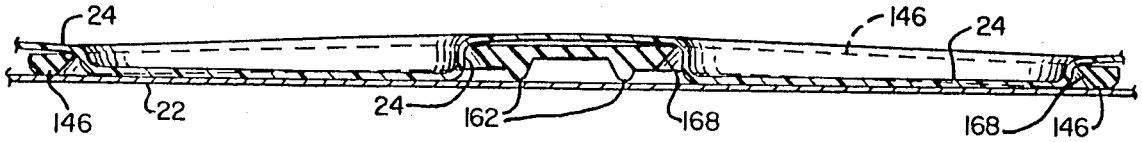
FIG. 13 is a sectional view, taken along line 13—13, of the attachment device shown in FIG. 11.

The waterbed sheet holding device 140 is used in the same manner as the attachment device 30, and, as may be seen in FIG. 13, the mattress 24 of a waterbed 10 protrudes downwardly within the openings 148, with the pressure within the mattress 24 tending to force the flexible fluid-containing membrane of the mattress tightly into contact with the sloping inner surfaces 168, forming a flexibly interlocking relationship between the mattress 24 and the retainer 142 and enhancing the resistance of the device 140 to motion relative to the waterbed mattress 24 and liner 22. The waterbed sheet retaining devices 140 may be made of the same material preferred for the waterbed sheet attachment devices 30, with the same combined effect of adhesion of the material of the device 140 to the surfaces of the waterbed mattress 24 and liner 22, together with the mechanical interaction between the protruding portion of the waterbed mattress 24 and the rim portions 146 of the retainer portion 142.

The terms and expressions which have been employed in the foregoing specification are used therein as terms of description and not of limitation, and there is no intention in the use of such terms and expressions, of excluding equivalents of the features shown and described or portions thereof, it being recognized that the scope of the invention is defined and limited only by the claims which follow.

What is claimed is:

1. A device for holding bedding neatly in place on a waterbed including a fluid-filled mattress supported within a waterbed frame structure, the device comprising:

(a) fastener means for gripping a portion of a bed cover for a waterbed;

(b) an elongate flexible elastic connector member having opposite first and second ends, said first end being attached to said fastener means; and (c) a relatively stiff, generally planar retainer member, said second end of said elastic connector member being attached to said retainer member, said retainer member being adapted for placement beneath the mattress and within the frame of a waterbed and said retainer member including means defining at least one opening extending therethrough for receiving a portion of the mattress of said waterbed protruding downwardly therethrough.

2. The device of claim 1 wherein said retainer includes a pair of sides which converge toward one another, defining an angle of about 90° at the location where said connector member is attached to said retainer.

3. The device of claim 2, said connector extending away from said retainer in the direction of an extension of the bisector of the angle defined by said sides.

4. The device of claim 1 wherein said retainer is at least about $\frac{1}{8}''$ thick

5. The device of claim 1 wherein said retainer member and connector are of integral construction with said retainer member being thicker and stiffer than said connector.

6. The device of claim 1 wherein said retainer member includes an upper major face including relatively raised portions located thereupon.

7. The device of claim 1 wherein said connector defines a loop at said first end and said fastener means is attached to said connector by said loop.

8. The device of claim 1 wherein said connector includes a pair of parallel elongate elastic parts spaced laterally apart from one another.

9. The device of claim 8 further including bridge means for connecting said parallel parts to each other at a location spaced apart from said first end a distance of about $\frac{1}{2}''$ to 3".

10. The device of claim 1 wherein said means defining at least one opening includes a plurality of rim portions defining respective openings through said retainer.

11. The device of claim 1 wherein said retainer is of a thermoplastic material which gradually adheres to and has a relatively high coefficient of friction against a flexible sheet plastic material of a waterbed mattress.

12. The device of claim 1 wherein said fastener portion thereof includes a first member having a lower end and an upper end and defining a longitudinal slot having an enlargement located proximate said lower end, said lower end of said first member being connected with said connector, said fastener means further including a stud having a head portion too large to pass through said enlargement of said slot, a base portion small enough to pass through said enlargement but too large to pass through the remainder of said slot, and a neck interconnecting said head and said base.

13. The device of claim 12 wherein said retainer, said connector, and said first part of said fastener means are formed integrally of a rubber-like thermoplastic material, and said connector having a thickness, with said retainer and said first member of said fastener means having respective thicknesses sufficiently greater than said thickness of said connector that said first portion of said fastener and said retainer are substantially stable in dimensions while said connector is elastically variable in length in response to changing tension applied to said device as a result of attachment of a bed sheet to a waterbed by said device.

14. A device for holding bedding neatly in place on a waterbed including a fluid-filled mattress supported within a waterbed frame structure, the device comprising:

(a) fastener means for gripping a portion of a bed cover for a waterbed;

(b) a generally planar retainer member adapted for placement beneath a fluid-filled mattress and within the frame of a waterbed, said retainer member including rim means defining at least one opening extending therethrough, for receiving a portion of the mattress of said waterbed protruding downwardly therethrough, said rim means including conical surface means providing space for expansion of a protruding portion of said mattress so as to interlockingly engage said opening; and (c) an elongate flexible elastic connector member extending from said retainer member and having an opposite end thereof attached to said fastener means.

15. A device for use in attaching bed covers to beds of the type including a supporting structure having a bottom and a plurality of upright side members attached to the bottom and surrounding a fluid-filled flexible mattress, the device comprising:

(a) a generally planar retainer member having a pair of major faces and a pair of sides convergent toward a corner portion of said retainer member, said pair of sides defining approximately a right angle with respect to each other in said corner portion, and said major faces defining a surface configuration adapted to resist slippage of said retainer member along a bottom surface of said fluid-filled flexible mattress;

(b) an elongate connector attached to and extending away from said corner portion of said retainer member, said connector including a pair of elastic cord-like members, each having an enlarged end; and (c) fastener means, including a plate member having a pair of hook members, each defining a throat area smaller than said enlarged end but large enough to receive one of said cord-like members, attached to said connector and spaced apart from said retainer member, for attaching said device to a bed cover while said retainer member is located between said bottom of said bed and said lower surface of said fluid-filled flexible mattress, so as to attach said bed cover to said bed.

16. The device of claim 15 wherein said retainer member includes at least one raised bar structure arranged transverse to the direction in which said connector extends from said retainer member.

17. The device of claim 15 wherein said retainer has an upper major face and includes a plurality of suction cups attached to said retainer and located on said upper major face thereof.

18. The device of claim 15, said fastener means including a stud having a base and head interconnected by a neck smaller than either head or base, said device further including a flexible elastic loop member connected to one of said cord-like members, said loop member being large enough to receive said stud by flexibly and elastically fitting over said base and thereafter fitting around said neck to retain said stud when said fastener is not in use to attach said device to a bed cover.

19. The device of claim 15 wherein said retainer member and said connector are of integral construction with said retainer member being thicker and stiffer than said connector.

20. The device of claim 15 wherein said connector defines a loop at said first end and said fastener means is attached to said connector by said loop.

21. The device of claim 18 wherein said retainer, said connector, and said first part of said fastener means are formed integrally of a rubber-like thermoplastic material, and said connector having a thickness, with said retainer and said first member of said fastener means having respective thicknesses sufficiently greater than said thickness of said connector that said first portion of said fastener and said retainer are substantially stable in dimensions while said connector is elastically variable in length in response to changing tension applied to said device as a result of attachment of a bed sheet to a waterbed by said device.

* * * * *